US007452244B2

(12) United States Patent
Rohrbach

(10) Patent No.: US 7,452,244 B2
(45) Date of Patent: Nov. 18, 2008

(54) CONNECTOR SYSTEM FACILITATING CONNECTION BETWEEN CONNECTORS DESIGNED FOR DIFFERENT PROTOCOLS

(75) Inventor: Matthew Rohrbach, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 11/228,414

(22) Filed: Sep. 15, 2005

(65) Prior Publication Data

US 2007/0059978 A1 Mar. 15, 2007

(51) Int. Cl.
*H01R 25/00* (2006.01)

(52) U.S. Cl. ..... 439/638

(58) Field of Classification Search ..... 439/680, 439/502, 352, 358, 362, 638
See application file for complete search history.

(56) References Cited

U.S. PATENT DOCUMENTS 5,820,414 A * 10/1998 Omori ..... 439/638
6,115,246 A * 9/2000 Ohnishi ..... 361/686
6,164,989 A * 12/2000 Glad et al. ..... 439/131
6,540,549 B2 * 4/2003 Rupert ..... 439/502
6,976,885 B2 * 12/2005 Lord ..... 439/680
7,052,282 B2 * 5/2006 Meleck et al. ..... 439/34
7,070,417 B2 * 7/2006 Meleck et al. ..... 439/34
7,086,898 B2 * 8/2006 Johnsen et al. ..... 439/579
7,090,524 B2 * 8/2006 Tanimoto et al. ..... 439/352
2003/0176109 A1 * 9/2003 Fukuchi et al. ..... 439/638

* cited by examiner

*Primary Examiner*—Chandrika Prasad
(74) *Attorney, Agent, or Firm*—Townsend and Townsend and Crew LLP

(57) ABSTRACT

A connector system and connector are disclosed. In a first aspect the connector system comprises a first connector having a first electrical connection for a first protocol and having a second electrical connection coupled to the first electrical connection for a second protocol. The connector system further includes a second connector coupled to and integrated with the first connector. The second connector has a third electrical connection for the second protocol wherein there is no cable between the first and second electrical connectors. In a second aspect, the connector comprises a housing; and a first electrical connection having a first protocol within the housing. The connector also includes a second electrical connection coupled to the first electrical connection and having a second protocol within the housing. Finally, the connector includes a screw assembly mechanism internal to the housing and accessible by a user to facilitate assembly or disassembly of the connector from a data source.

15 Claims, 7 Drawing Sheets

102"

CONNECTOR SYSTEM FACILITATING CONNECTION BETWEEN CONNECTORS DESIGNED FOR DIFFERENT PROTOCOLS

FIELD OF THE INVENTION

The present invention relates generally to a connector system and more specifically to a connector system that is utilized for connecting a data source to a display.

BACKGROUND OF THE INVENTION

It is known that many computers and other data sources are connected to a display device by means of a connector system. Conventional (legacy) displays, or other display devices such as projectors, often have a low end connector such as a video graphics array or VGA connector which is designed to be used to connect the display device to an appropriate signal source, such as that provided by a computer. However, contemporary computers and other sources of a visual or audio signal often have a high end digital video connector such as a digital visual interface or DVI output connector instead of a VGA output connector.

For example, FIG. 1 shows a conventional system 10 for connecting together a VGA display with a computer. The conventional system 10 comprises a cable 12 connected to a VGA connector 14, and another connector 16 connected via a second cable 18 to a DVI connector 20. The DVI connector 20 is then attached/plugged in to an audio or video signal source 22, which in this embodiment is a personal computer such as a Macintosh computer.

Using the conventional connection system 10, it is possible to connect a VGA cable 12 to a DVI cable 18, and to realize a successful, though not always highest quality, signal transfer. However, because many contemporary computers have become miniaturized in size and length, the larger size and longer lengths of the cables often result in a connection system which may be larger and longer than the computer itself, resulting in considerable inconvenience, loss of visual attractiveness, and degraded quality of signal transfer.

Utilizing such a conventional system 10 to connect a VGA and a DVI connector, it is also necessary for the user to manually tighten the two screws 24*a* and 24*b* located on the VGA connector 14 and the two screws 26*a* and 26*b* located on the DVI connector 20 so that a secure attachment can be made, in order to provide the highest possible signal quality and also to avoid interruptions or distortions in signal quality. However, tightening the afore-mentioned screws can be very difficult for people with larger hands or fingers, or who must adjust the connectors while working in very small spaces.

Accordingly, what is needed is a system and method for connecting a VGA or other type of connector from a display device or the like to a DVI connection on a signal source such as a personal computer. The system and method needs to be as compact as possible. The system and method also needs to enable the user to adjust connectors to form a secure connection in as easy and simple/efficient a way as possible, thereby creating a high quality signal transfer without image distortion or loss. The present invention addresses such a need.

SUMMARY OF THE INVENTION

A connector system and connector are disclosed. In a first aspect the connector system comprises a first connector having a first electrical connection for a first protocol having a second electrical connection coupled to the first electrical connection for a second protocol. The connector system further includes a second connector coupled to and integrated with the first connector. The second connector has a third electrical connection for the second protocol wherein there is no cable between the first and second electrical connectors.

In a second aspect, the connector comprises a housing; and a first electrical connection having a first protocol within the housing. The connector also includes a second electrical connection coupled to the first electrical connection and having a second protocol within the housing. Finally, the connector includes a screw assembly mechanism internal to the housing and accessible by a user to facilitate assembly or disassembly of the connector from a data source.

DETAILED DESCRIPTION

The present invention relates generally to a connector system and more specifically to a connector system that is utilized for connecting a data source to a display. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

A connector system in accordance with the present invention allows for an integrated and compact connection between a data source, which may be but is not limited to being a computer, and a display. Accordingly, what is provided is a connector which incorporates the standard functionality of two different connection protocols in a single connector. In so doing, a system is provided which is more versatile and can be utilized in a more robust way than conventional connector systems. To describe the features of the present invention in more detail, refer now to the following figures.

Figure 1:
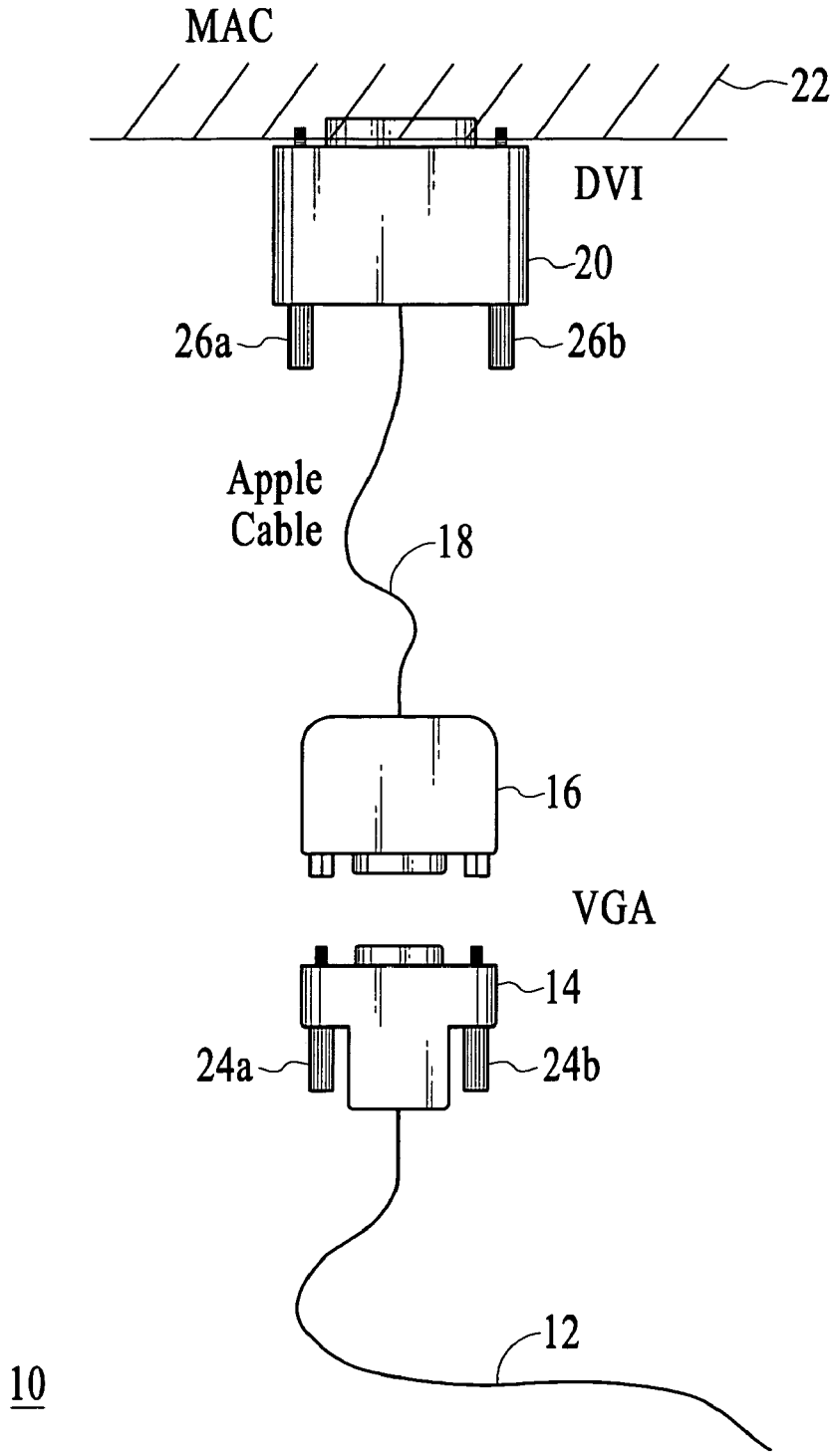
FIG.1 (Prior Art)
FIG. 1 shows a conventional system 10 for connecting together a VGA display with a computer.
Figure 2:
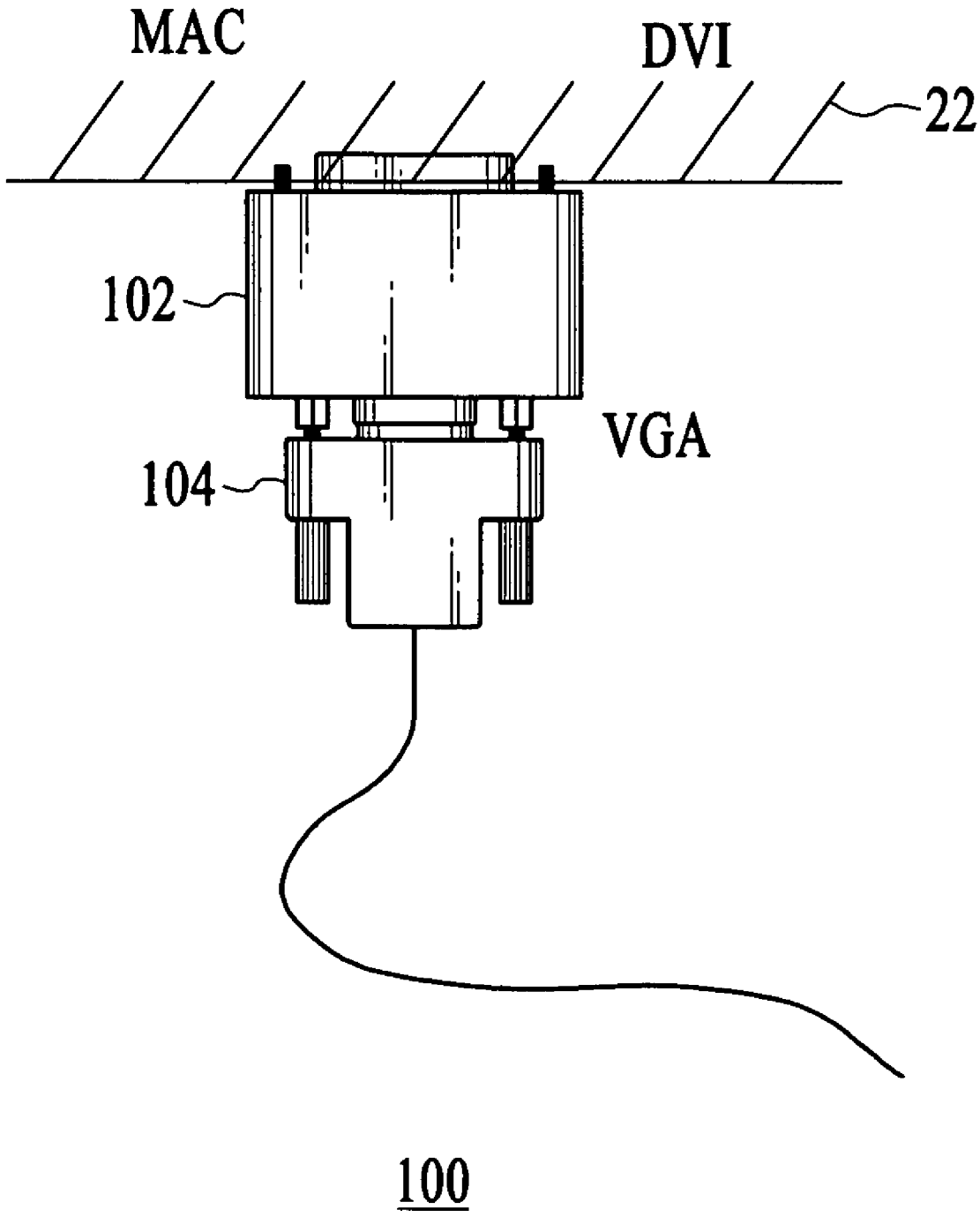
FIG. 2 shows a connector system in accordance with the present invention.

FIG. 2 shows a connector system 100 in accordance with the present invention. The connector system 100 comprises a high end connector such as a DVI connector 102 in accordance with the present invention coupled to a legacy connector such as a VGA connector 104. In this embodiment the DVI connector 102 is coupled to a data source which is a Macintosh computer. In this integrated system, the connector cable 18 and VGA connector 16 shown in FIG. 1 are no longer needed, thereby reducing the length of cable and number of connecting devices required.

Although the connector system 100 utilizes a DVI connector 102 and a VGA connector 104, one of ordinary skill in the art recognizes that there are other types of connectors between data sources such as computers and display devices which could be used, and that the connector system 100 in accordance with the present invention would still provide the same functions.

Figure 3:
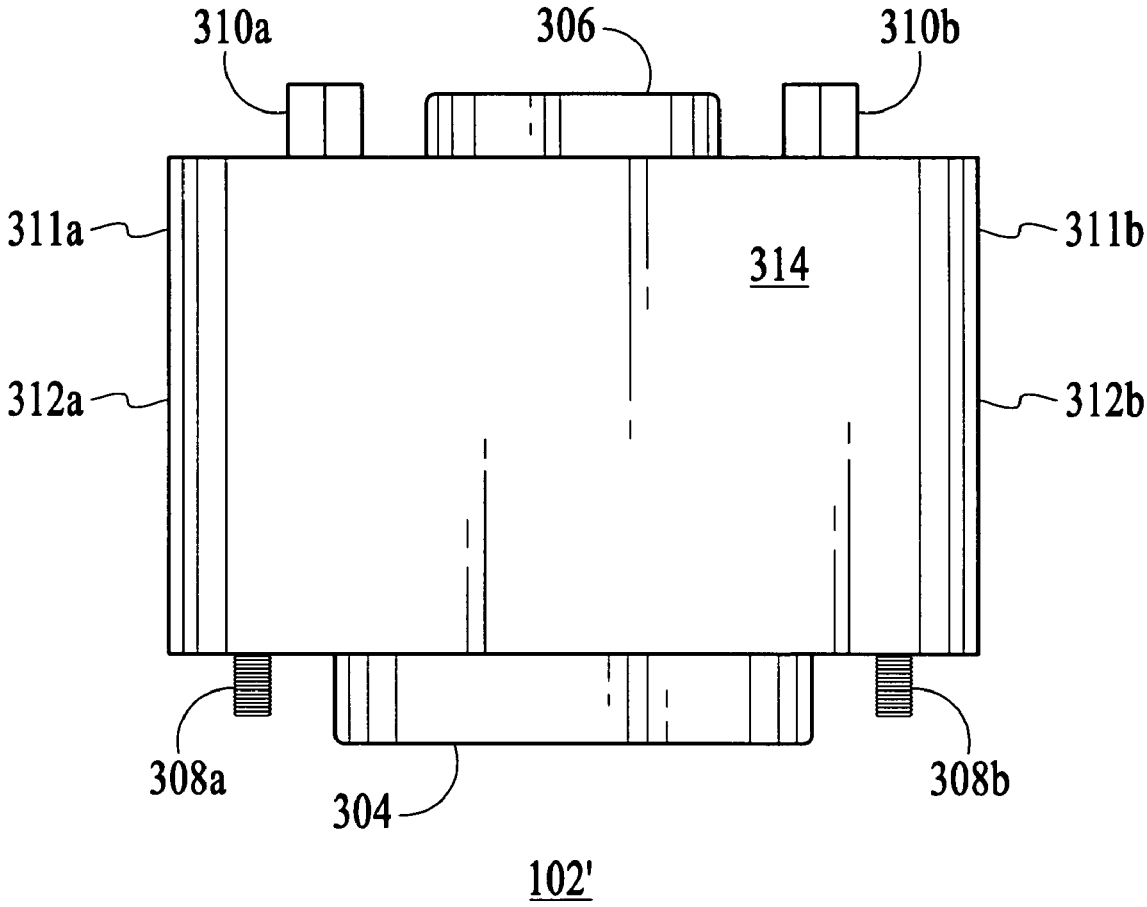
FIG. 3 shows a top view of a connector in accordance with the present invention.

FIG. 3 shows a more detailed top view of a connector 102' in accordance with the present invention. The connector 102' comprises a housing 314, a screw assembly mechanism, a first electrical connection, for example a DVI connection 304 and a second electrical connection, for example, a VGA connection 306. The screw assembly mechanism includes two screws 308*a* and 308*b* internal to the housing 314 for connecting the first electrical connection 304 to the data source (not shown) which are configured so that the heads are almost flush with but slightly above the connector surface, and knobs 312*a* and 312*b* which are also internal to the housing 314 for connecting the second electrical connection 102 to a display device (not shown) and which encase their respective screws 308*a* and 308*b*. Openings 311*a* and 311*b* expose the knobs 312*a* and 312*b* respectively. The tightening or loosening action of the screws 308*a* and 308*b* is actuated by a finger by turning knobs 312*a* and 312*b* in a clockwise or counter clockwise direction.

Referring again to FIG. 3, the VGA connection 306 of the connector 102' has two nuts 310*a* and 310*b*. These two nuts 310*a* and 310*b* are fastened to the VGA connector coming from the display device (not shown) in the conventional way.

Figure 4:
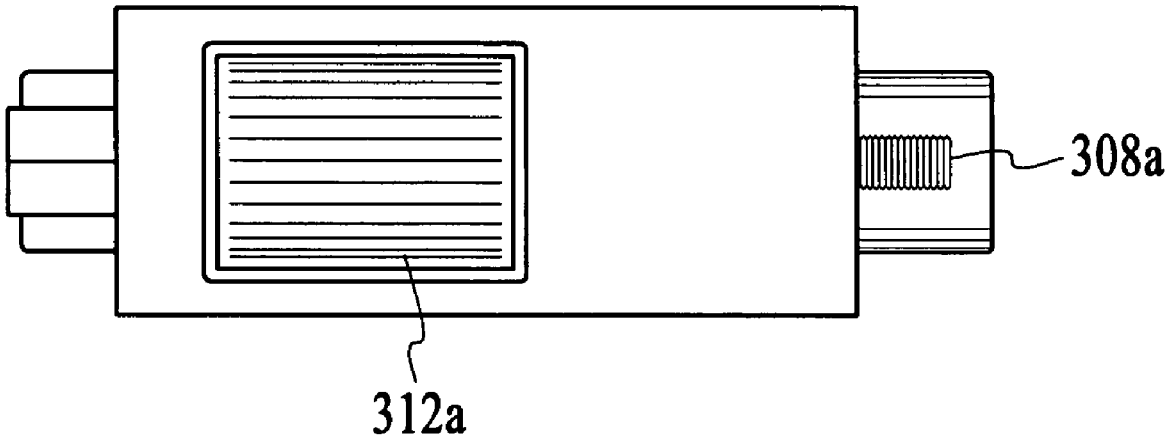
FIG. 4 shows a side view of a connector in accordance with the present invention.

FIG. 4 shows a side view of the connector 102" in accordance with the present invention. The knob 312*a* on the side of the connector 102" is shown more clearly in this figure. A similar knob 312*b* (not shown in FIG. 4) is also located on the opposite side of the connector 102", as shown in FIG. 3. As before mentioned, the knobs 312*a* and 312*b* (not shown) are used to move their corresponding screws 308*a* and 308*b* (not shown) in and out, thereby tightening or loosening the connection between the connector 102" and the computer (not shown) attached thereto.

Figure 5:
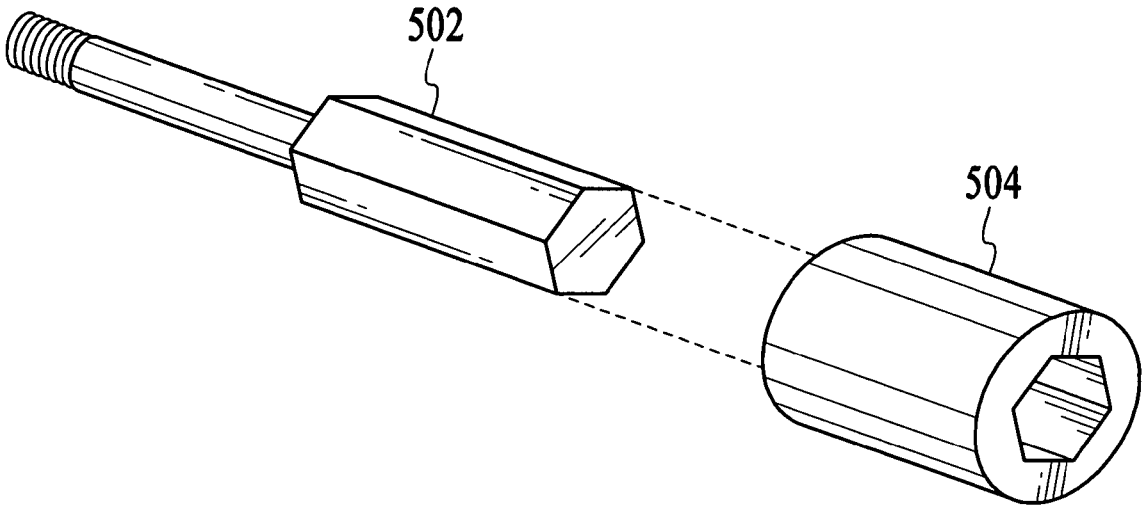
FIG. 5 shows a fixed nut and hex in accordance with the present invention.
Figure 6:
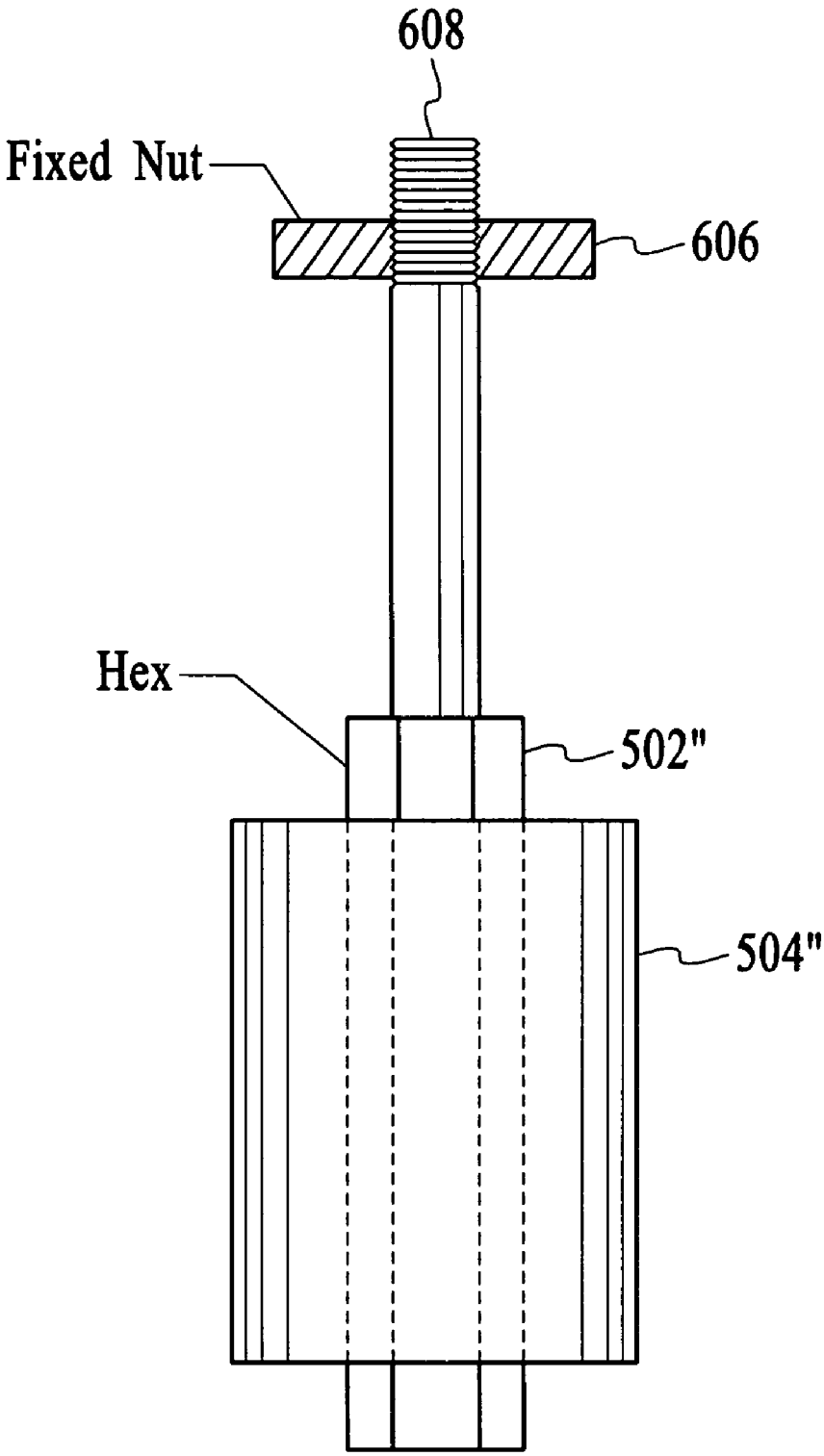
FIG. 6 shows a screw which fits onto the hex shown in FIGS. 4*a* and 4*b*.

To more clearly describe the operation of the screw assembly mechanism 500 in accordance with the present invention, refer now to FIG. 5. FIG. 5 shows a hex 502 and knob 504 in accordance with the present invention. FIG. 6 shows how the hex 502' fits into the knob 504'. The hex 502" is also attached to a fixed nut 606 and has a screw tip 608. This system provides for stabilizing the connection between the connector 102 (not shown) and the DVI connection located on the computer (not shown).

Although in this embodiment the DVI connection includes the inventive screw assembly shown in FIGS. 5 and 6, one of ordinary skill in the art recognizes that VGA, DVI or other similar connectors could also include such a screw assembly, and the screw assembly would function in the same manner.

Accordingly, what is provided is a connector which incorporates the functionality of two different protocols (i.e., VGA and DVI) in a single connector. In so doing, a system is provided which is more versatile and can be utilized in a more robust way than previous connector systems.

One should readily recognize that although the present invention has been described in conjunction with a particular type of connector, this system could be used within a variety of environments and they would be within the spirit and scope of the present invention.

Figure 7:
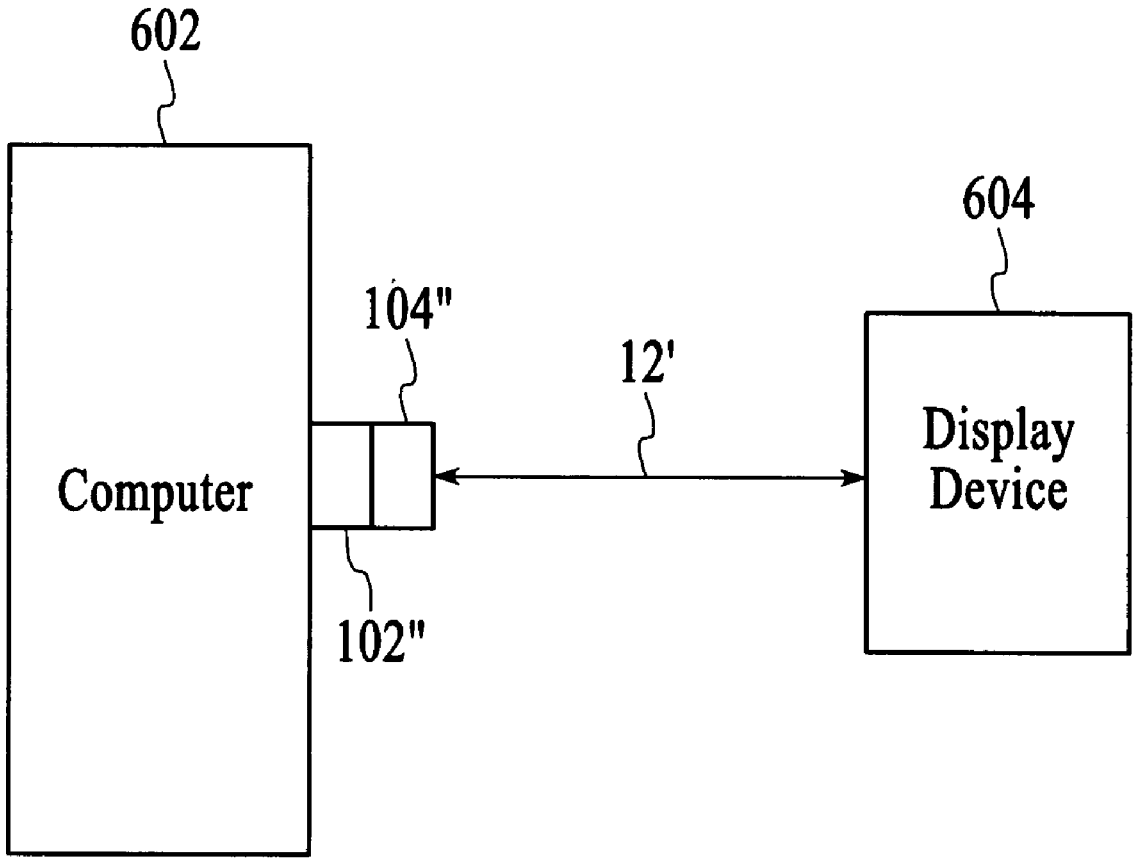
FIG. 7 shows a system which utilizes a connector system.

FIG. 7 shows a system which includes a connector system in accordance with the present invention. As is seen, the connector system comprises a VGA connector 104", a cable 12' connecting the VGA connector 104" and a display device 604, and a DVI connector 102" connected to a computer 602. In this embodiment, either connector 102" or 104" could include the connection interface in accordance with the present invention. The computing device could be any source of data including but not limited to a computer, PDA, or portable computer. Similarly, the display device could be any display device including but not limited to a video projector, high definition television, portable display, etc.

The connector in accordance with the present invention is compact enough that its size does not exceed the size of the personal computer or other source of audio or video signal, thereby eliminating user inconvenience and visual unattractiveness. The connector also enables the user to easily adjust the tightness of the connection by means of a screw assembly system, thereby providing a means for simply and efficiently forming a secure connection even in a small or awkward space, and creating a high quality signal transfer without image distortion or loss.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A connector apparatus comprising:

a housing having at least one side surface having an opening;

a first connector end situated on the housing and configured to electrically and mechanically couple to a first connection;

a screw assembly at least partially located within the housing, the screw assembly including a knob rotatable about an axis of the housing to rotate a screw, a first portion of the screw being disposed inside and rotationally constrained by the knob, and a second threaded portion of the screw extending outside the housing, wherein a portion of the knob is exposed for user access through the opening, and wherein the knob is linearly fixed in relation to the axis of the housing such that when rotated the screw moves in and out of the housing depending on the direction of rotation, and wherein the screw assembly is configured to fasten the first connector end to the first connection;

a second connector end situated on the housing and configured to electrically and mechanically couple to a second connection; and a fastening mechanism situated on the housing and configured to fasten the second connector end to the second connection.

2. The connector apparatus of claim 1 wherein the first connection is adapted for a first data signaling protocol and the second connection is adapted for a second data signaling protocol that is different than the first data signaling protocol.

3. The connector apparatus of claim 1, wherein the knob is disposed substantially internal to the housing.

4. The connector apparatus of claim 1, wherein a portion of the screw configured for coupling with the knob is substantially hexagonal in cross section and is inserted into a corresponding hexagonal aperture in the knob.

5. The connector apparatus of claim 1 further comprising a second screw assembly integral to the housing and including a second knob rotatable about the axis of the housing to rotate a second screw, wherein the second knob is exposed for user access through an aperture on the housing that faces a direction substantially perpendicular to the axis.

6. The connector apparatus of claim 2, wherein one of the first and second data signaling protocols comprises an analog protocol and the other one of the first and second data signaling protocol comprises a digital protocol.

7. The connector apparatus of claim 2, wherein the first and the second data signaling protocols comprise video signals.

8. The connector apparatus of claim 2, wherein one of the first and second connector ends is configured to couple to a data source and the other of the first and second connector ends is configured to couple to a display device.

9. The connector apparatus of claim 8, wherein the data source comprises one of a portable computer, personal digital assistant, personal computer, or video camera.

10. The connector apparatus of claim 8, wherein the display device comprises one of a video camera, computer display, or video projector.

11. The connector apparatus of claim 1 wherein physical dimensions of the first connector end are different than physical dimensions of the second connector end.

12. The connector apparatus of claim 1 wherein the fastening mechanism comprises a plurality of nuts.

13. A connector apparatus comprising:

a housing, the housing including a first side, a second side, and a third side, the first side being the opposite of the second side, the third side being substantially perpendicular to the first side and having an opening;

a first connector extruding from the first side, the first connector being configured to mechanically and electrically couple to a first connection adapted for a first data signaling protocol;

a second connector extruding from the second side, the second connector being configured to mechanically and electrically couple to a second connection adapted for a second data signaling protocol different than the first data signaling protocol, the second connector being electrically coupled to the first connector internal to the housing; and a screw assembly, the screw assembly being at least partially located within the housing and situated on the third side, the screw assembly including a knob rotatable about an axis of the housing to rotate a screw, the axis being along the third side, a first portion of the screw being disposed inside and rotationally constrained by the knob, and a second threaded portion of the screw extending outside the housing, the knob being exposed for user access through the opening, and wherein the knob is linearly fixed in relation to the axis of the housing such that when rotated the screw moves in and out of the housing depending on the direction of rotation, and wherein the screw assembly is configured to fasten the first connector to the first connection;

wherein the connector apparatus enables data transmission between the first connection and the second connection.

14. The connector apparatus of claim 13, wherein the knob is disposed substantially internal to the housing.

15. The connector apparatus of claim 13, wherein a portion of the screw configured for coupling with the knob is hexagonal in cross section and is inserted into a corresponding hexagonal aperture in the knob.

* * * * *